United States Patent [19]

Karmel

[11] 4,267,537

[45] May 12, 1981

[54] RIGHT CIRCULAR CYLINDRICAL SECTOR CAVITY FILTER

[75] Inventor: Paul R. Karmel, Potomac, Md.

[73] Assignee: Communications Satellite Corporation, Washington, D.C.

[21] Appl. No.: 34,697

[22] Filed: Apr. 30, 1979

[51] Int. Cl.[3] ..... H01P 7/06; H01P 1/20; H01P 3/12

[52] U.S. Cl. ..... 333/231; 333/212; 333/248

[58] Field of Search ..... 333/208, 212, 227, 231–248

[56] References Cited

U.S. PATENT DOCUMENTS

| | | | |
|---|---|---|---|
| 2,513,334 | 7/1950 | Kirkman et al. | 333/106 |
| 2,637,004 | 4/1953 | Malter | 333/230 |
| 2,658,165 | 11/1953 | Evans et al. | 333/230 |
| 2,864,063 | 12/1958 | Felsen et al. | 333/157 |
| 2,910,620 | 10/1959 | Jenny | 333/33 |
| 2,963,663 | 12/1960 | Felsen et al. | 333/24 |
| 3,010,088 | 11/1961 | Kahn | 333/21 |
| 3,176,234 | 3/1965 | Kluver | 15/5.49 |
| 3,969,692 | 7/1976 | Williams et al. | 333/212 |
| 4,060,779 | 11/1977 | Atia et al. | 333/21 A |
| 4,122,419 | 10/1978 | Brady et al. | 333/232 |

OTHER PUBLICATIONS

"Narrow-Band Multiple Coupled Cavity Synthesis", IEEE Transactions on Circuits and Systems, Sep. 1974, pp. 649–655.

"Narrow-Bandpass Waveguide Filters", IEEE Transactions on Microwave Theory and Techniques, Apr. 1972, pp. 258–265.

"General $TE_{011}$-Mode Waveguide Bandpass Filters", IEEE Transactions on Microwave Theory and Techniques, Oct. 1976, pp. 640–648.

"Microwave Filters, Impedance Matching Networks and Coupling Structures", by G. L. Matthei et al., McGraw-Hill, 1965, pp. 232–243, 924–926.

*Primary Examiner*—Alfred E. Smith
*Assistant Examiner*—Thomas P. O'Hare
*Attorney, Agent, or Firm*—Sughrue, Rothwell, Mion, Zinn and Macpeak

[57] ABSTRACT

A compact low loss microwave filter is disclosed which utilizes an angular section of a right circular cylindrical cavity at the resonance structure excited in the circular electric $TE_{0mn}$ mode. The individual sectors may be electrically or magnetically coupled through common walls to obtain various filter characteristics.

2 Claims, 14 Drawing Figures

$E_r = 0$
$E\phi = J_0'(k_1 r)\sin(\pi z/L)$
$E_z = 0$
$H_r = k_3/k\, J_0'(k_1 r)\cos(\pi z/L)$
$H\phi = 0$
$H_z = k_1/k\, J_0(k_1 r)\sin(\pi z/L)$
WHERE $k_1 = 7.664/D$ $k_3 = \pi/L$, $k^2 = k_1^2 + k_3^2$
L = CAVITY LENGTH, D = CAVITY DIAMETER FIG 4
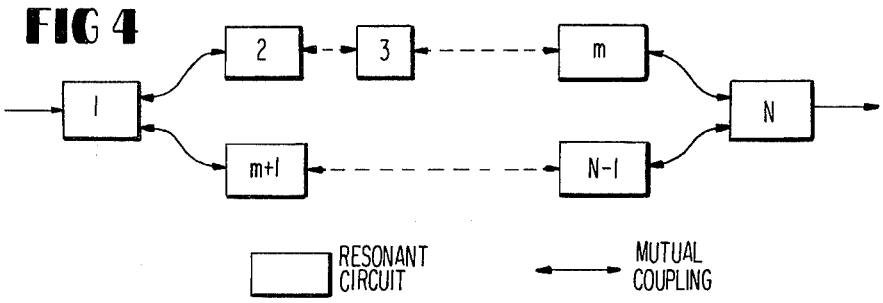
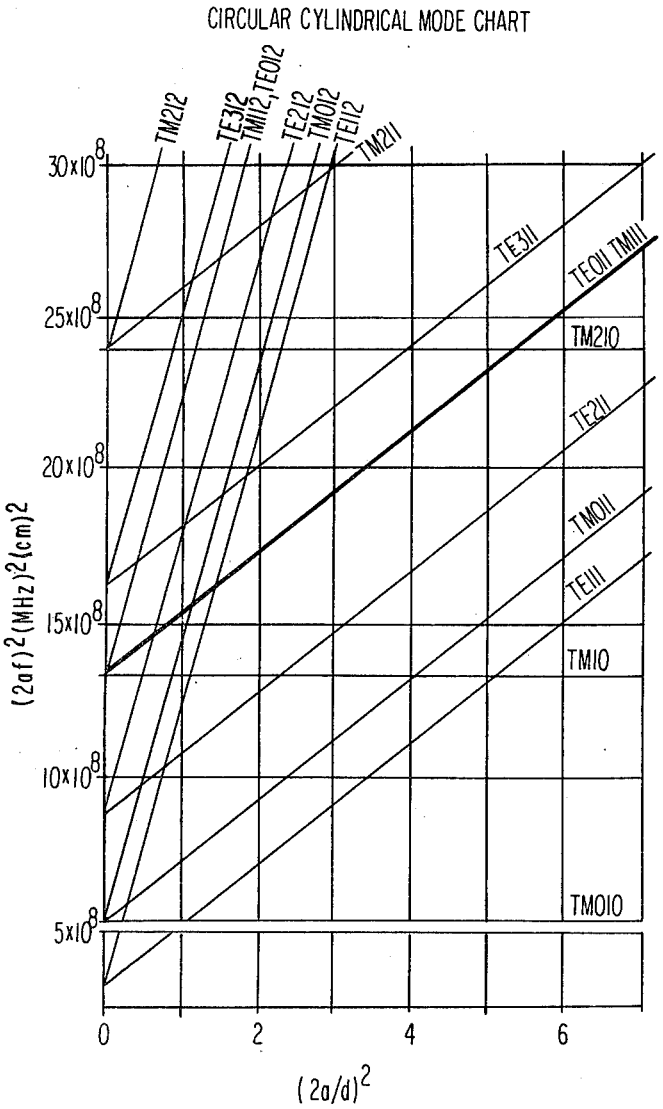
FIG 5(a)

DIVIDER THICKNESS 0.030, WALL THICKNESS AT WAVEGUIDE TO CAVITY SLOTS 0.030, FOUR TUNING SCREWS AT RADIUS OF 0.97", ONE IN EACH CAVITY.

FREQUENCY BROAD BAND SWEEP

RIGHT CIRCULAR CYLINDRICAL SECTOR CAVITY FILTER

BACKGROUND OF THE INVENTION

Microwave communications systems require filters with sharp frequency selectivity, flat in-band slope and small group delay. Many applications, particularly for satellite systems, necessitate that these characteristics be realized in a device of minimum weight and volume. These requirements have been met by constructing narrow bandpass waveguide filters employing multiple-coupled cavities.

A number of filter structures have been proposed in which circular cylindrical cavities are utilized which are resonant in the $TE_{111}$ mode or the $TE_{011}$ mode. One such structure is disclosed in U.S. Pat. No. 3,969,692. A number of these cavities are used in each filter structure and are either electrically or magnetically coupled by suitable apertures at contiguous points between cavities. $TE_{011}$ mode filters generally have higher Q's (lower losses) than $TE_{111}$ mode filters, but this advantage is offset by the somewhat larger size requirements and more restricted frequency band in which no other mode is excited. Further, the $TM_{111}$ mode is degenerate with the $TE_{011}$ mode, i.e. any cavity designed to support $TE_{011}$ resonance will also be capable of supporting $TM_{111}$ resonance. Thus, the $TM_{111}$ resonance must be suppressed in some way.

A disadvantage which is characteristic of both $TE_{111}$ and $TE_{011}$ mode filters is that, in cases where a multi-cavity filter is required, for example N cavities, the filter structure must include N separate cylindrical cavities so that the resulting filter structure has a volume which is N times the volume of a single cavity and a weight which is also increased proportionally.

This drawback is somewhat alleviated by the use of dual mode filter structures, such as that described in application Ser. No. 754,804, now U.S. Pat. No. 4,060,779 filed Dec. 27, 1976 and assigned to the same assignee as the present invention. However, even in the case of such dual mode filters, an N-cavity electrical filter will still require N/2 physical cavities. Thus, there is a need for a more compact N-cavity filter structure.

BRIEF DESCRIPTION OF THE DRAWINGS

FIG. 2(*b*) illustrates the electric field component $E_\phi$ in a sectorial cavity according to the present invention;

FIG. 4 is a block diagram of the equivalent circuit of the filter structure shown in FIG. 3;

SUMMARY OF THE INVENTION

It is an object of this invention to provide a more compact N-cavity circular cylindrical filter structure.

It is a further object of this invention to provide an N-cavity filter structure in which each cavity is resonant in a $TE_{0nm}$ mode and in which the entire filter consisting of all N-cavities is realized in a single circular cylindrical cavity.

It is a further object of this invention to provide a filter structure which inherently eliminates a number of resonant modes associated with a complete circular cavity and, thus, yields a wider frequency band free of unwanted modes.

Briefly, these and other objects are achieved by providing conducting radial planes which divide the cylindrical cavity into a plurality of sectorial cavities, each of the sectorial cavities being resonant in the $TE_{Omn}$ mode. The cavities can be coupled by apertures in common radial walls to provide positive or negative mutual coupling, and any two cavities may be chosen for input and output coupling. The radial conducting planes will eliminate many of the resonant modes associated with conventional complete circular cavities (one of these being the undesirable $TM_{111}$ mode) but do not unacceptably interfere with the $TE_{0nm}$ mode.

DETAILED DESCRIPTION OF THE PREFERRED EMBODIMENTS

Figure 1:
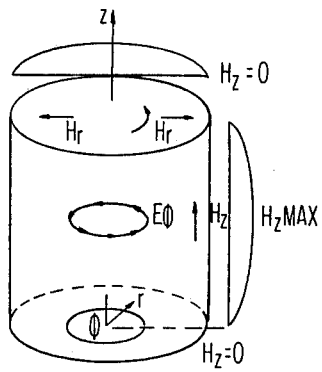
FIG. 1 illustrates the electric and magnetic fields of the $TE_{011}$ circular mode.
Figure 2A:
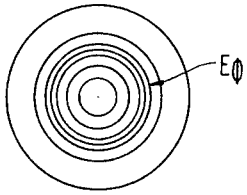
FIG. 2(*a*) illustrates the electric field component $E_\phi$ in a $TE_{011}$ mode circular cylindrical waveguide.
Figure 2B:
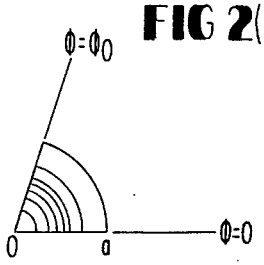

An example of a prior art circular cylindrical waveguide filter in which the present invention is an improvement is disclosed in U.S. Pat. No. 3,969,692. In that filter structure, each of the circular cylindrical cavities is resonant in the $TE_{011}$ mode and coupling between cavities is provided by apertures in adjacent end walls or tangential side walls. FIG. 1 illustrates the electric and magnetic fields of such a $TE_{011}$ circular mode cavity. FIG. 2(*a*) is an end view of a circular cylindrical cavity illustrating only the electric field component $E_\phi$ from FIG. 1. The present invention is based upon the principle that conducting planes which are normal to the electric field orientation will not change that $TE_{Omn}$ mode of resonance. In an open cavity, if the conductive plane is normal to the E field, the E field will terminate at the conductive plane and begin again at the other side as if the conductive plane were nonexistent. However, this inventor has realized that, by forming sectorial cavities with conductive radial planes, the E field will not reappear on the other side of each conductive plane since there will no longer exist the required excitation. The sectorial cavities will, however, remain capable of supporting the original $TE_{0nm}$ mode. Thus, by providing coupling apertures in the conductive radial planes, each sector will function as a separate cavity resonant in the $TE_{Onm}$ mode. Due to this characteristic, the placement of conducting radial planes at $\phi=0$ and $\phi_0$ as shown in FIG. 2(*b*) will not change the mode of resonance and, therefore, the sectorial cavity defined by the outer cylindrical wall and the conducting radial planes in FIG. 2(*b*) will support the same electric field $E_\phi$ as in the full circular cylindrical cavity in FIG. 2(*a*).

Since, as is known in the art, the radius and length of the cavity will determine the resonant frequency, a sectorial cavity shown in FIG. 2(*b*) with the same radius and length as its full circle counterpart will support a resonant $TE_{011}$ mode at the same frequency. This applies to all the $TE_{0mn}$ circular electric modes but other TE and TM modes may disappear or be altered depending upon the choice of the angle $\phi_0$ since the conducting radial planes will not be perpendicular to the electric field orientation in those modes.

Figure 3:
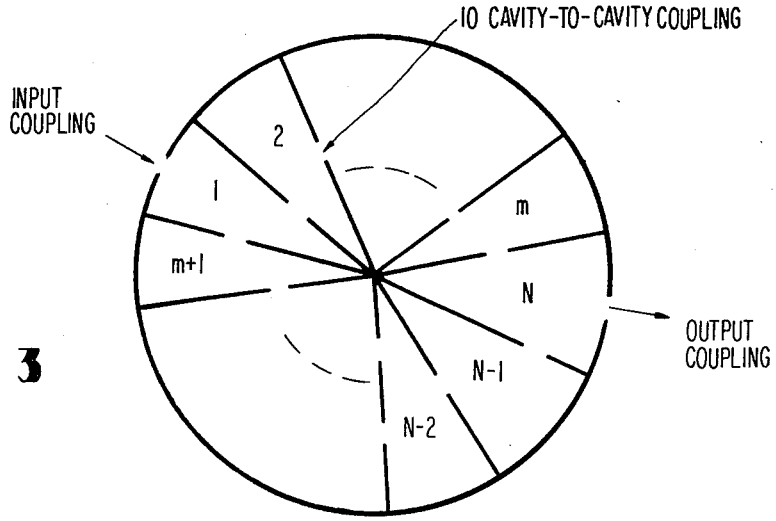
FIG. 3 is a schematic end view of a generalized sectorial filter structure according to the present invention.

Shown in FIG. 3 is a generalized sectorial filter structure according to the present invention. When $\phi_0$ in FIG. 2(*b*) is chosen as $\pi/N$ radians, a full circular cylindrical cavity will then be divided into 2 N sectorial cavities as shown in FIG. 3. The respective sectorial cavities can then be either electrically or magnetically coupled through apertures in common walls to provide positive or negative mutual coupling, and any two cavities may be chosen for input and output coupling. In FIG. 3, cavity number 1 receives the input while the output is taken from cavity N. The equivalent filter structure is schematically illustrated in FIG. 4.

Coupling between adjacent cavities is provided by apertures in common cavity walls, positive coupling being obtained from a slot parallel to the magnetic field lines and negative coupling being obtained from a circular hole in a plane perpendicular to the electric field lines. It will be appreciated, of course, that any aperture in a radial wall will be perpendicular to the E field, but if the longest dimension of the slot is in a direction parallel to the magnetic field the coupling will be predominantly magnetic and positive, whereas a hole which is substantially circular will provide predominantly electric and negative coupling as is known in the art. Slot and hole dimensions may be calculated by formulas similar to those used for the full circle cavity, as described by G. L. Matthei, L. Young, and E. M. T. Jones, *Microwave Filters, Impedance Matching Networks and Coupling Structures,* New York: McGraw-Hill, 1965, pp. 232–243, 924–926.

As will be easily apparent from the illustration of FIG. 3, a significant reduction in size and weight of the filter structure is achieved by realizing a multiple-cavity filter in the same space as conventionally required for a single full circle cavity. It should, of course, be appreciated that it would be possible to arrange a plurality of the filter structures shown in FIG. 3 in end-to-end fashion and to couple the cavities through apertures in the common end walls of each sectorial cavity.

Figure 5B:
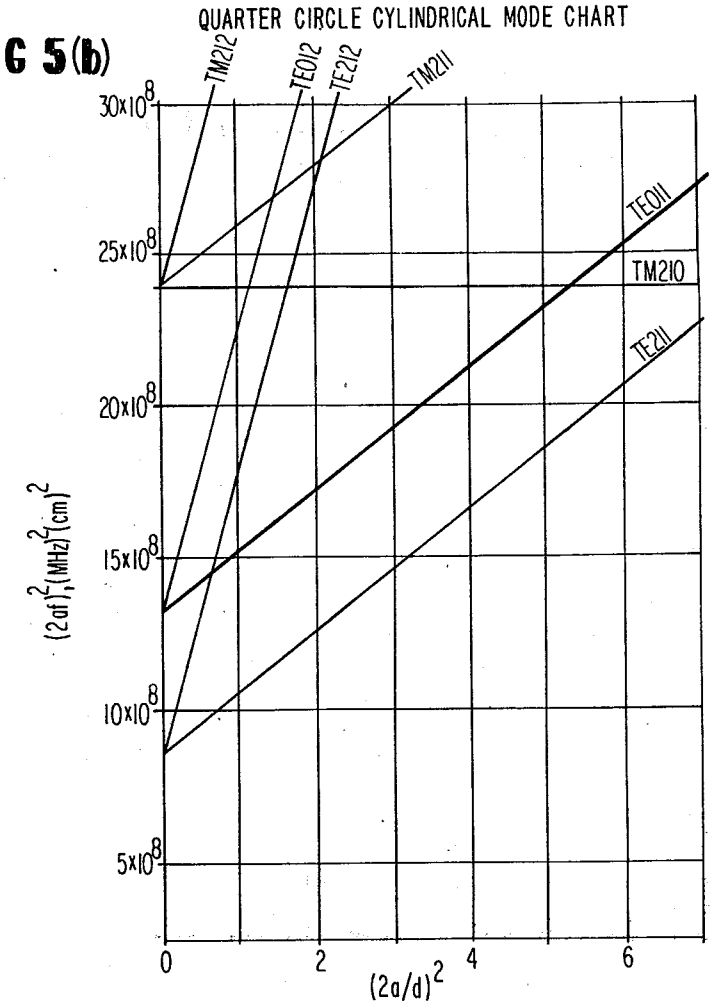
FIGS. 5(*a*) and 5(*b*) are mode charts for a full circular cylindrical cavity and sectorial cavity, respectively.

The sectorial cavity shown in FIG. 3 will support additional TE and TM modes at their resonant frequencies. In particular, when $\phi=\pi/N$, these modes are identical to those of the full circular cavity. However, besides the $TE_{0mn}$ modes, only $TE_{pmn}$ and $TM_{pmn}$ modes with $P=Nl$, $l=1, 2, 3 \ldots$ can exist. Thus, the radial planes act as mode suppressors. A significant advantage is the suppression of the degenerate $TM_{111}$ since, for $N \geqq 2$, the $TM_{111}$ mode cannot exist. Consequently, the frequency band around the $TE_{011}$ resonance mode which is free of other modes is increased. FIG. 5(*a*) shows a mode chart for a conventional full circular cavity, where a is the radius of the cavity and b is the length or height, thereof, both dimensions being in centimeters. Note that the $TM_{111}$ mode is degenerate with the $TE_{011}$ mode. FIG. 5(*b*) is a mode chart for a quarter-circular cylindrical cavity, i.e., a sectorial cavity according to the present invention wherein $N=2$ so that the full circular cylindrical cavity is split into four 90° sectors. In this cavity, the $TM_{111}$ mode is suppressed as well as the $TM_{011}$, $TE_{311}$, $TE_{112}$ and $TM_{012}$ modes. This allows a relatively free choice of the radius-to-length ratio (2 a/d) without the danger of spurious responses in the immediate vicinity of the desired resonance.

The $TE_{011}$ mode fields for the sectorial cavity according to the present invention are:

$$H_z = H_o J_o\left(\frac{P_1 r}{a}\right) \sin\frac{\pi z}{d}$$

$$H_r = \left(\frac{\pi a}{p_1 d}\right) H_o J_1\left(\frac{p_1 r}{a}\right) \cos\frac{\pi z}{d}$$

$$E_\phi = \left(\frac{k_1 a Z_0}{p_1}\right) H_o J_1\left(\frac{p_1 r}{a}\right) \sin\frac{\pi z}{d}$$

where:

$\phi_0$=sector angle a=radius d=height $$k_1 = \sqrt{\left(\frac{\pi}{d}\right)^2 + \left(\frac{p_1}{a}\right)^2}$$

$p_1=3.832 \ldots, J_o'(p_1)=J_1(p_1)=0$ $$f_0 = \frac{k_1}{2\pi\sqrt{\mu_0\epsilon_0}} = \text{resonant frequency}$$

The Quality factor (Q) for this mode is:

$$Q\frac{\partial_s}{\lambda_0} = \frac{\left[p_1^2 + \left(\frac{\pi}{2}\right)^2\left(\frac{2a}{d}\right)^2\right]^{3/2}}{2\pi\left[p_1^2 + \left(\frac{\pi}{2}\right)^2\left(\frac{2a}{d}\right)^3 + \frac{p_1}{\phi o}F\right]}$$

where:

$F=7.78+3.89\,(\pi/2p_1)^2\,(2a/d)^2$ $\lambda_0$=resonant wavelength $\delta_s$=skin depth of conducting wall.

A slight disadvantage of the sectorial filter structure according to the present invention is that the radial planes used to form the sectors are adjacent to the longitudinal and radial magnetic field components $H_z$ and $H_r$ illustrated in FIG. 1. Thus, radial and longitudinal currents will flow on the surfaces of the radial planes, and these currents will produce losses which reduce the Q of the cavity. This loss due to the radial side walls of each sector is reflected by the F term in the denominator of equation (1). The corresponding Q formula for a conventional full circle cavity would be given by equation (1) with $F=0$. As $\phi_0$ decreases, thus increasing the number of cavities N, the stored energy within each cavity will decrease and the losses in the end walls and the cylindrical wall (at $r=a$) will decrease proportionally. However, the loss in the two radial walls of each cavity will remain constant and, thus, the Q will decrease.

Figure 6:
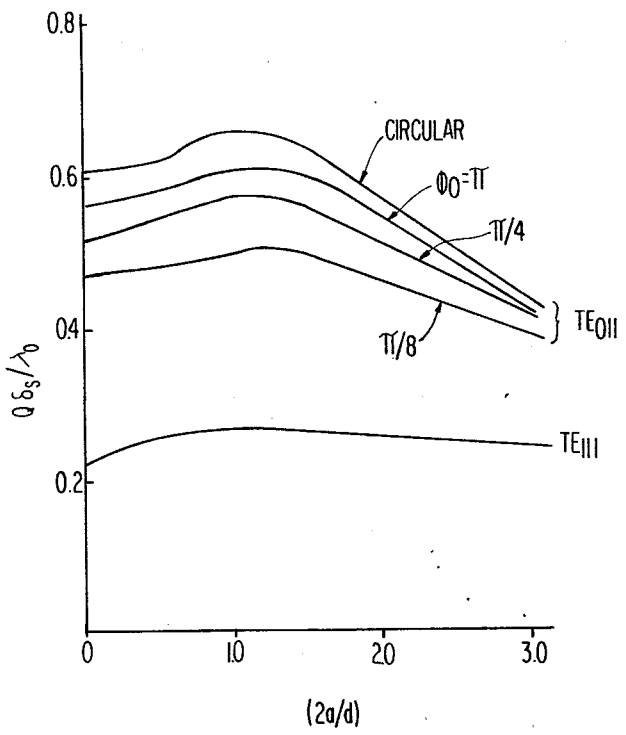
FIG. 6 is a plot of the theoretical Q's for a conventional full circle cavity and for sectorial cavities according to the present invention.

FIG. 6 is a plot of the theoretical Q's for the full circle cavity ($F=0$) and for various values of $\phi_0$ for a $TE_{011}$ and $TE_{012}$ mode cavity. The Q for the $TE_{111}$ in a full circle cavity is shown for comparison. Thus, it is clear that, although the Q of the sectorial cavity structure according to the present invention is not quite as high as that of the full circle cavity, it is still higher than the conventional full circle $TE_{111}$ mode cavity for large (2 a/d) values and for small (2 a/d) for the semicircular and quarter-circular sectorial cavities. Even for smaller sectorial cavities it is only slightly lower than for $TE_{111}$ cavities. Further, although the peak theoretical Q's for the $TE_{011}$ mode sectorial cavities are somewhat reduced from the peak value in the full circle cavity, the full circle $TE_{011}$ mode cavity is typically constructed at a diameter-to-length ratio yielding a factor of 0.95 below peak Q to avoid spurious resonant modes. Thus, the drop in Q-factor in the sectorial filter structure according to the present invention is less significant in view of the significant size and weight savings.

It should be noted that longitudinal currents flow in the radial walls onto the end walls where the currents are circular. Thus, the currents must cross the junction between the radial and end walls and a good electrical contact between these walls is necessary. Accordingly, it is not possible to use a non-contacting plunger for tuning the cavities as is typical in conventional full circle cavities. Instead, tuning may be accomplished by screws inserted into each sector through the end plates.

It should also be noted that, although the slot and hole dimensions for coupling adjacent cavities may be calculated according to conventional formulas, the waveguide-to-cavity coupling formula must be adjusted for the reduced energy stored in the sectorial cavity, and the cavity-to-cavity formula must be modified to include the radial position of the slot. This is simply accomplished by substituting the reduced energy value into conventional formulas and modifying the cavity-to-cavity formula to reflect the radial position in the cavity at which maximum coupling can be obtained.

EXAMPLE 1

Figure 7B:
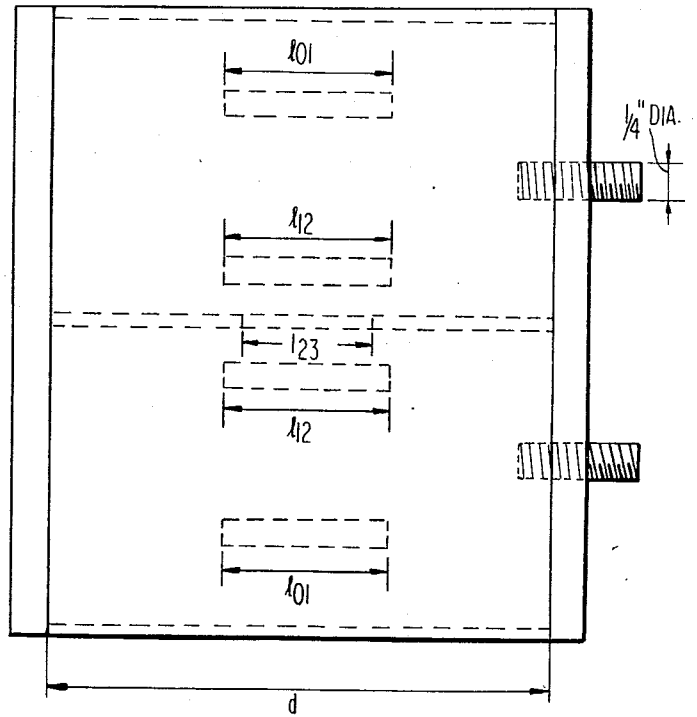
FIGS. 7(*a*) and 7(*b*) are end and side views, respectively, of one example of a sectorial filter according to the present invention.
Figure 7A:
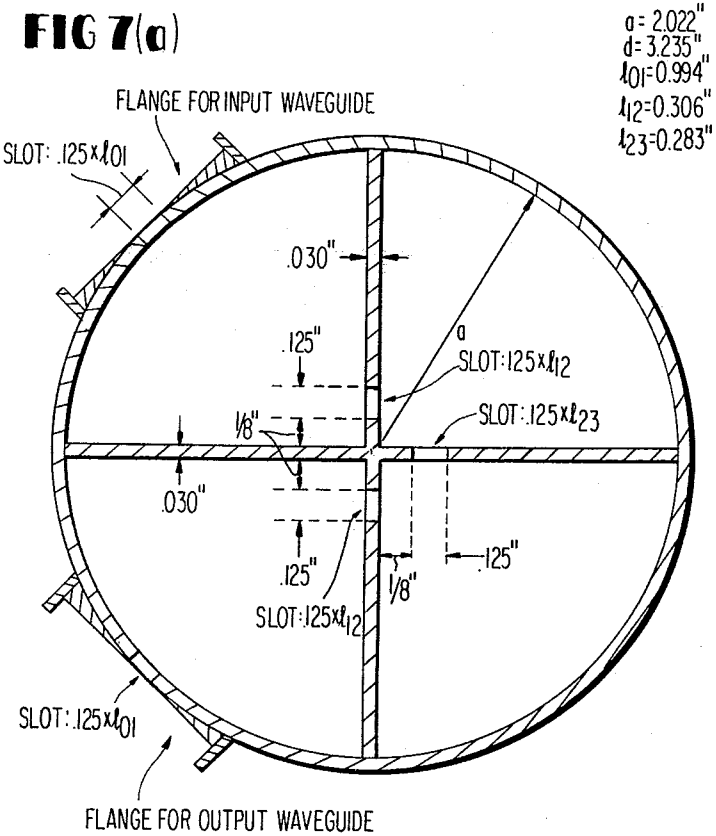

A 4-cavity, 4-GHz filter with an elliptic transfer function was designed and built to demonstrate the desirable characteristics of a sectorial cavity filter. The ratio (2 a/d) was selected at 1.25 for maximum theoretical unloaded Q as shown in FIG. 6. The resonant frequency of each cavity is related to the radius a and the length d by:

$$(2af_0) = \left(\frac{p^1c}{\pi}\right)^2 + \left(\frac{2a}{d}\right)^2\left(\frac{c}{2}\right)^2$$

giving a radius a of 2.022 inches and a length d of 3.235 inches. The mode chart of FIG. 5(*b*) indicates operation which is free of spurious modes between the $TE_{211}$ mode at 3.373 GHz to the $TE_{212}$ at 4.622 GHz. The cavity coupling slot dimensions were determined by using the formulas previously described. The actual coupling values were then measured and the slot size adjusted to achieve the desired coupling values. Measurements of inter-cavity couplings is described in A. E. Atia and A. E. Williams, "Measurements of Inter Cavity Couplings", *IEEE Transactions on Microwave Theory and Techniques,* Vol. MTT 23, pp. 519–522, June 1975. The experimental model was constructed with removable top and bottom radial plates and with separate outer sectors which bolt together, tightly clamping the plates. FIG. 7(*a*) is a longitudinal view of the experimental model, and FIG. 7(*b*) is a side sectional view along lines A—A of FIG. 7(*a*).

Figure 8:
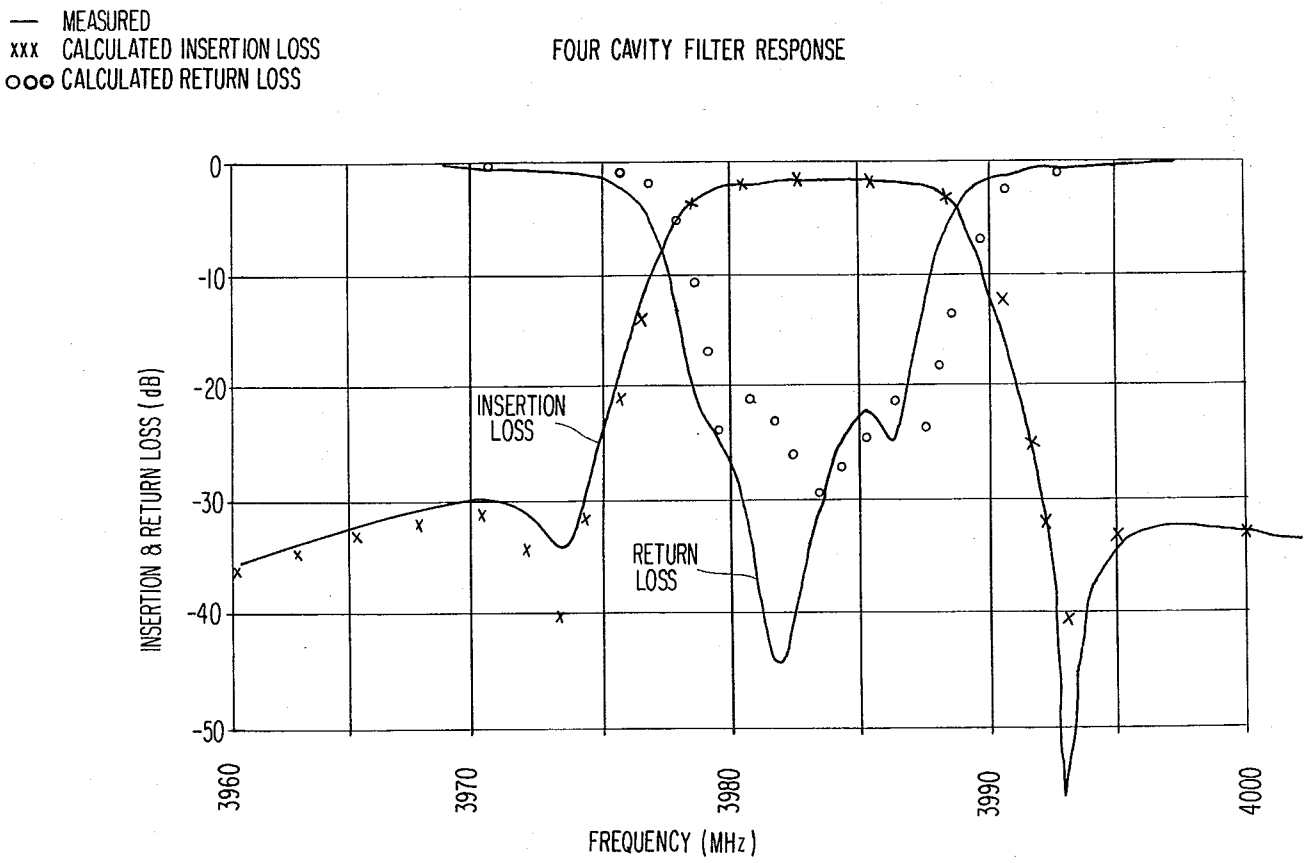
FIG. 8 is a graphical illustration of the measured filter response the sectorial cavity filter structure of FIG. 7.

The measured filter response of the 4-cavity experimental model is illustrated in FIG. 8. The center frequency insertion loss of 1.5 dB corresponds to an unloaded Q of only 5,000 for the sectorial cavity compared to a calculated value in aluminum of 32,000. It is probable that this low Q is caused by losses in poor electrical contact between the radial plates and the outer cylindrical walls and the top and bottom plates. This would be significantly improved if the entire device is plated and soldered for improved electrical performance.

Figure 9:
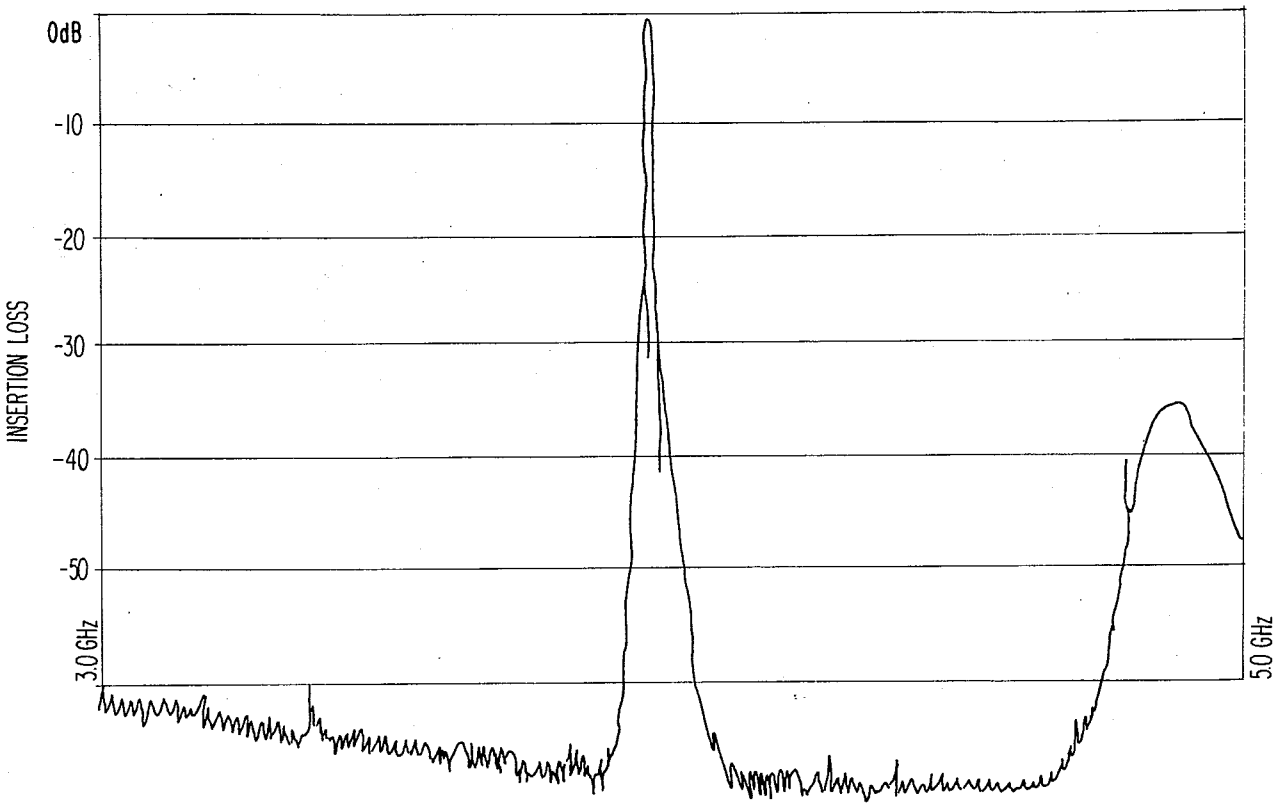
FIG. 9 is a plot of the measured filter response during wide band sweep of the sectorial cavity filter structure of FIG. 7.
Figure 10A:
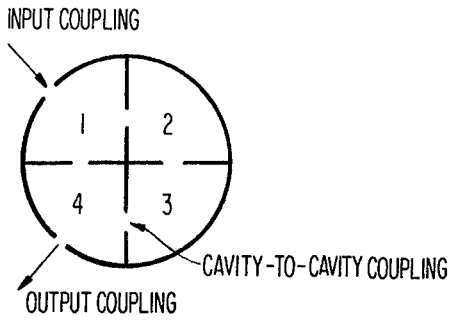
FIGS. 10(*a*)–10(*d*) illustrated alternative structures of sectorial filters according to the present invention.
Figure 10B:
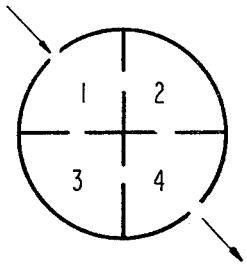
Figure 10C:
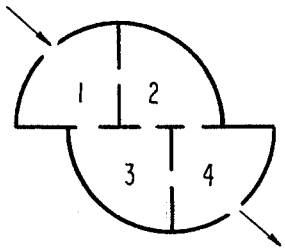
Figure 10D:
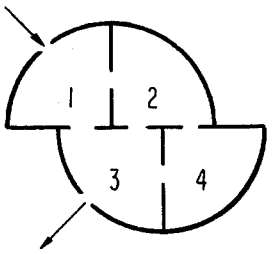

FIG. 9 is a graphical illustration of the insertion loss measured during a wide band sweep.

FIGS. 10(*a*)–10(*d*) illsutrate various possibilities for four cavity filter structures according to the present invention. In FIG. 10(*a*) the input and output are taken from adjacent cavities, in FIG. 10(*b*) from diametrically opposite cavities. FIGS. 10(*c*) and 10(*d*) are similar to FIGS. 10(*b*) and 10(*a*), respectively, except that the two halves of the cylindrical structure are offset with respect to one another.

While a particular example of the present invention has been disclosed, it should be appreciated that a number of changes in the disclosed example could be made. The exemplary model was designed to operate in the $TE_{011}$ mode, but sectorial multi-cavity filters could be made for resonance in any $TE_{0nm}$ mode. As in the $TE_{011}$ mode, the radial planes would suppress many of the other modes with resonances close to that of the desired $TE_{0nm}$ mode.

Further, it should be appreciated that the sectorial cavities may be arranged to overlap longitudinally and the electric or magnetic coupling apertures may occur at end walls as well as the side walls of the sectorial cavities.

The above-described sectorial multi-cavity filter structure results in a $TE_{011}$ mode filter having a Q which is significantly higher than conventional $TE_{111}$ mode full circle cavity filters. Although the Q is lower than that of a conventional full circle $TE_{011}$ mode filter, the other considerations, i.e., the significant savings in size and weight and the suppression of various resonant modes to provide a wide range of operation free of spurious modes, make the disclosed filter structure highly desirable for many applications.

What is claimed is:

1. A multiple-coupled cavity waveguide bandpass filter comprising (a) a plurality of resonant sectorial cavities, each comprising a sector of a circular cylinder and being defined by two planar conductive members of length d and width a which intersect at one end at an angle $\phi$ to form a pair of radial walls, each of said planar conductive members having one or more apertures which couple energy between adjacent resonant sectorial cavities, and (b) an outer conductive surface of length d and radius of curvature a connecting the other ends of said planar conductive members to form a circumferential wall, and (c) a pair of conductive end plates separated by length d and enclosing either end of said sectorial cavity, wherein the respective sectorial cavities, by apertures in said conductive members, are selectively coupled electrically to provide negative mutual coupling and magnetically to provide positive mutual coupling one of said sectorial cavities being coupled at its circumferential wall to an input waveguide and another of said sectorial cavities being coupled at its circumferential wall to an output waveguide.

2. A multiple-coupled cavity waveguide bandpass filter as defined in claim 1 comprising 2 N sectorial cavities each having a sector angle of $\pi/N$ radians.

* * * * *